US007762409B2

(12) United States Patent
Vickroy

(10) Patent No.: US 7,762,409 B2
(45) Date of Patent: Jul. 27, 2010

(54) APPARATUSES FOR HOLDING HANGERS

(75) Inventor: Samuel C. Vickroy, Madison, AL (US)

(73) Assignee: SCV Quality Solutions, LLC, Madison, AL (US)

( * ) Notice: Subject to any disclaimer, the term of this patent is extended or adjusted under 35 U.S.C. 154(b) by 471 days.

(21) Appl. No.: 11/498,679

(22) Filed: Aug. 3, 2006

(65) Prior Publication Data

US 2008/0029470 A1 Feb. 7, 2008

(51) Int. Cl.
*A47F 7/19* (2006.01)
*A47F 5/08* (2006.01)

(52) U.S. Cl. ..... 211/113; 248/317

(58) Field of Classification Search ..... 211/85.3, 211/89.01, 113, 117, 118, 119.004, 124; 248/227.4, 228.7, 229.16, 229.26, 230.7, 248/231.81, 339; 24/9, 10 R, 18, 343, 344, 24/346, 464, 483, 512, 514; 223/85, 90, 223/91, 93, 96; 482/38, 115, 40, 904; 297/274; 472/135; 294/19.1, 81.1, 81.21, 81.3, 81.5, 294/81.6, 99.1, 118, 154; 81/53.12
See application file for complete search history.

(56) References Cited

U.S. PATENT DOCUMENTS

| | | | | | |
|---|---|---|---|---|---|
| 37,686 | A | * | 2/1863 | Goldthwait | 211/113 |
| 73,801 | A | * | 1/1868 | Hale | 297/274 |
| 121,722 | A | * | 2/1871 | Keene | 211/85.3 |
| 113,126 | A | * | 3/1871 | Ziegler | 294/118 |
| 156,254 | A | * | 10/1874 | Mathewson | 211/117 |
| 338,606 | A | * | 3/1886 | Morley | 119/808 |
| 576,865 | A | * | 2/1897 | Leonhardt | 211/113 |
| 741,202 | A | * | 10/1903 | Weston | 211/85.3 |
| 801,902 | A | * | 10/1905 | Clafson | 81/53.12 |
| 852,951 | A | * | 5/1907 | Harnisohfegeh | 452/193 |
| 919,731 | A | * | 4/1909 | May | 294/22 |
| 1,002,767 | A | * | 9/1911 | Serp | 38/71 |
| 1,050,365 | A | * | 1/1913 | Kriz | 24/9 |
| 1,132,190 | A | * | 3/1915 | Kohout | 211/85.3 |
| 1,343,057 | A | * | 6/1920 | Lee | 294/118 |
| 1,664,415 | A | * | 4/1928 | Herzog | 211/113 |
| 1,956,502 | A | * | 4/1934 | Galatowitsch | 248/343 |
| 2,123,601 | A | * | 7/1938 | Gehrig | 24/66.2 |
| 2,209,953 | A | * | 8/1940 | Youngquist | 211/113 |
| 2,285,000 | A | * | 6/1942 | Columbus | 24/10 R |
| 2,309,948 | A | * | 2/1943 | Goebel | 56/333 |
| 2,401,148 | A | * | 5/1946 | Gaffney | 211/124 |
| 2,480,327 | A | * | 8/1949 | Idelsohn | 211/113 |
| 2,502,815 | A | * | 4/1950 | Beebe | 254/393 |
| 2,505,159 | A | * | 4/1950 | Teague | 211/113 |
| 2,580,193 | A | * | 12/1951 | Richterkessing | 211/113 |
| 2,815,555 | A | * | 12/1957 | Robbins | 24/514 |

(Continued)

*Primary Examiner*—Michael Safavi
*Assistant Examiner*—Joshua Rodden
(74) *Attorney, Agent, or Firm*—Ann I. Dennen; Lanier Ford Shaver & Payne P.C.

(57) ABSTRACT

A clothes hanger support apparatus from which clothes hangers may be suspended is described. The support apparatus is comprised of a clamp having members that are pivotally coupled on their bottom ends and have flanges extending inward from their top ends. When the apparatus is in the closed position, the flanges rest on the top of the horizontal moldings of a doorframe or window frame. Cords are attached to the members and pull the members together using the weight of a hanger bar that is attached to the cords.

12 Claims, 6 Drawing Sheets

U.S. PATENT DOCUMENTS 3,028,974 A * 4/1962 Loeb ..... 211/113
3,082,031 A * 3/1963 Lindberg ..... 294/111
3,179,256 A * 4/1965 Underwood ..... 211/118
3,314,636 A * 4/1967 McHugh ..... 248/340
3,327,376 A * 6/1967 Freeman et al. ..... 29/225
3,441,147 A * 4/1969 Kelley ..... 211/113
3,456,262 A * 7/1969 Coon ..... 24/501
3,527,357 A * 9/1970 Johnson ..... 211/113
3,631,543 A * 1/1972 Laauser ..... 4/558
3,716,232 A * 2/1973 Johnson et al. ..... 482/40
3,752,525 A * 8/1973 Hanna et al. ..... 294/74
3,830,507 A * 8/1974 Johnson ..... 294/112
3,835,535 A * 9/1974 Robison et al. ..... 30/249
3,904,197 A * 9/1975 Canonge ..... 482/81
3,906,957 A * 9/1975 Weston ..... 606/205
3,972,337 A * 8/1976 Pomaro ..... 132/213.1
4,010,517 A * 3/1977 Kapstad ..... 24/67.11
4,374,600 A * 2/1983 van Zelm ..... 294/19.1
4,417,713 A * 11/1983 Snowden et al. ..... 248/231.85
4,506,669 A * 3/1985 Blake, III ..... 606/150
4,601,261 A * 7/1986 Genelin ..... 119/839
4,613,179 A * 9/1986 van Zelm ..... 294/19.1
4,619,447 A * 10/1986 Blake ..... 269/221
4,667,913 A * 5/1987 Peelle et al. ..... 248/228.7
4,758,035 A * 7/1988 Shimasaki ..... 294/19.1
D305,722 S * 1/1990 Riehm ..... D8/72
4,921,069 A * 5/1990 Boyles ..... 182/135
4,934,089 A * 6/1990 Samar ..... 43/5
5,048,825 A * 9/1991 Kelly ..... 482/94
5,050,750 A 9/1991 Mason
5,251,767 A * 10/1993 Wiederer ..... 211/124
5,288,283 A * 2/1994 Meeker ..... 482/69
5,317,806 A * 6/1994 Held et al. ..... 30/249
D348,706 S * 7/1994 Harrell ..... D21/691
5,333,743 A 8/1994 Loewke et al.
D355,533 S * 2/1995 Meeker ..... D6/347
5,388,664 A * 2/1995 Bator ..... 182/100
5,413,298 A * 5/1995 Perreault ..... 248/228.6
5,429,571 A * 7/1995 Smith et al. ..... 482/115
5,438,759 A * 8/1995 Dieringer ..... 30/234
5,460,373 A * 10/1995 McNutt ..... 463/47.2
5,634,276 A * 6/1997 Lin ..... 30/249
5,745,998 A * 5/1998 Le et al. ..... 30/249
5,795,004 A * 8/1998 Zimmerman ..... 294/119
5,809,623 A * 9/1998 Dykstra ..... 24/514
5,947,875 A * 9/1999 Cone et al. ..... 482/69
5,950,315 A * 9/1999 Linden ..... 30/249
6,086,030 A 7/2000 Hepworth
6,142,433 A 11/2000 Winger
6,152,313 A 11/2000 Klein et al.
6,196,398 B1 3/2001 Lowe
6,503,175 B1 * 1/2003 Harrell ..... 482/38
6,629,720 B1 * 10/2003 Evans ..... 296/184.1
6,648,411 B2 * 11/2003 Julien ..... 297/274
6,705,974 B1 * 3/2004 Tardif ..... 482/39
D518,534 S * 4/2006 Giordano ..... D21/662
2004/0073208 A1 * 4/2004 Sutter ..... 606/49

* cited by examiner

APPARATUSES FOR HOLDING HANGERS

BACKGROUND OF THE DISCLOSURE

1. Filed of the Disclosure

This disclosure generally relates to hanger support devices that support hangers with clothes and more particularly to a portable hanger support apparatus.

2. Related Art

A variety of portable hanger support devices are available for holding and supporting the hook end of a clothes hanger. A conventional portable support device, typically mounted on a door, has a support structure with a downward facing channel that clips over the top a door and a support rod or bar extends from the support structure. Other conventional hanger support devices may fit over a horizontal molding of a doorframe or window frame. Such hanger support devices tend to push, since they are wedged behind the molding, the molding away from the frame and wall above the frame. In general, it is undesirable to push the molding outward from the doorframe or window frame since a space is created between the molding and the wall. Hence, there is a need for an improved portable hanger support apparatus that is attached to the horizontal molding of a doorframe or a window frame. Further, it would be desirable if such an improved apparatus was easy to store and was also cost competitive with conventional portable hanger support devices.

In general, there are numerous portable hanger support devices that rely on a variety of attachment methods to secure a structure with a support bar to doors and moldings. Many such conventional devices often have a weight capacity limitation because of the device's structure. Hence, it would be of desirable if a new a hanger support apparatus had better weight capacity characteristics. It would be desirable for such a new apparatus to have some of the features of conventional portable hanger devices, such as, ease of installation and removal, and being small to minimize storage space when not in use.

SUMMARY OF THE DISCLOSURE

The present disclosure generally pertains to a portable apparatus and method for supporting for clothes hangers.

An embodiment of an exemplary apparatus of the disclosure comprises a clamp with a first member and a second member, wherein each member has a flange on one end for griping horizontal moldings of a doorframe. The other ends of the members are pivotally coupled together. Further, a cord is connected to each member and crosses over to and extends downward and through a hole in the opposing member. The end of each cord that extends through the hole is coupled to an end of a support bar.

It is to be understood that both the foregoing general description and the following detailed description are merely exemplary of the disclosure, and are intended to provide an overview or framework for understanding the nature and character of the apparatus as it is claimed. The accompanying drawings are included to provide further understanding of the disclosure, illustrate various embodiments of the disclosure and together with the description serve to explain the principles and operation of the disclosure.

BRIEF DESCRIPTION OF THE DRAWING

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the figures.

DETAILED DESCRIPTION

Figure 1:
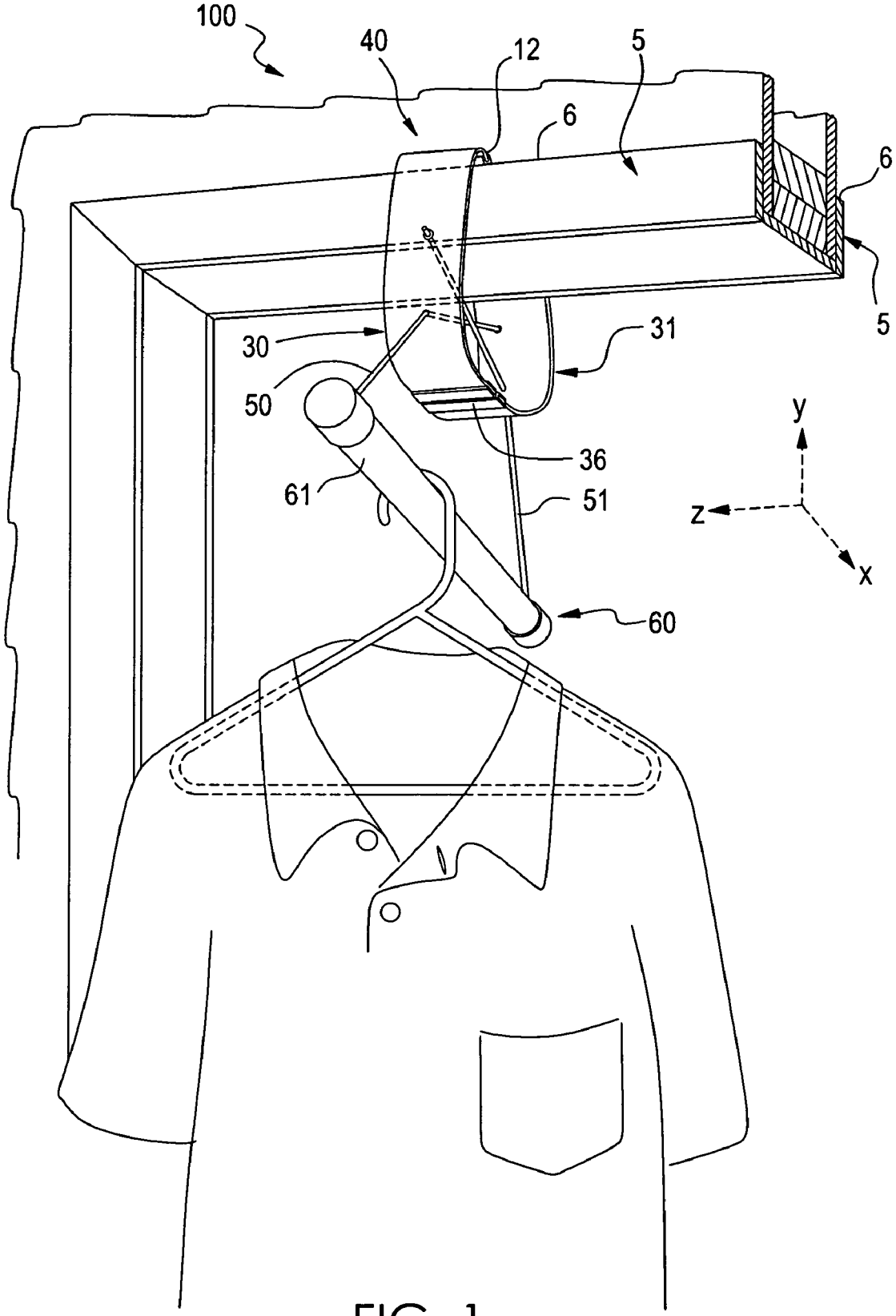
FIG. 1 illustrates an exemplary embodiment of a clothes support apparatus for holding hangers and clothes.
Figure 2:
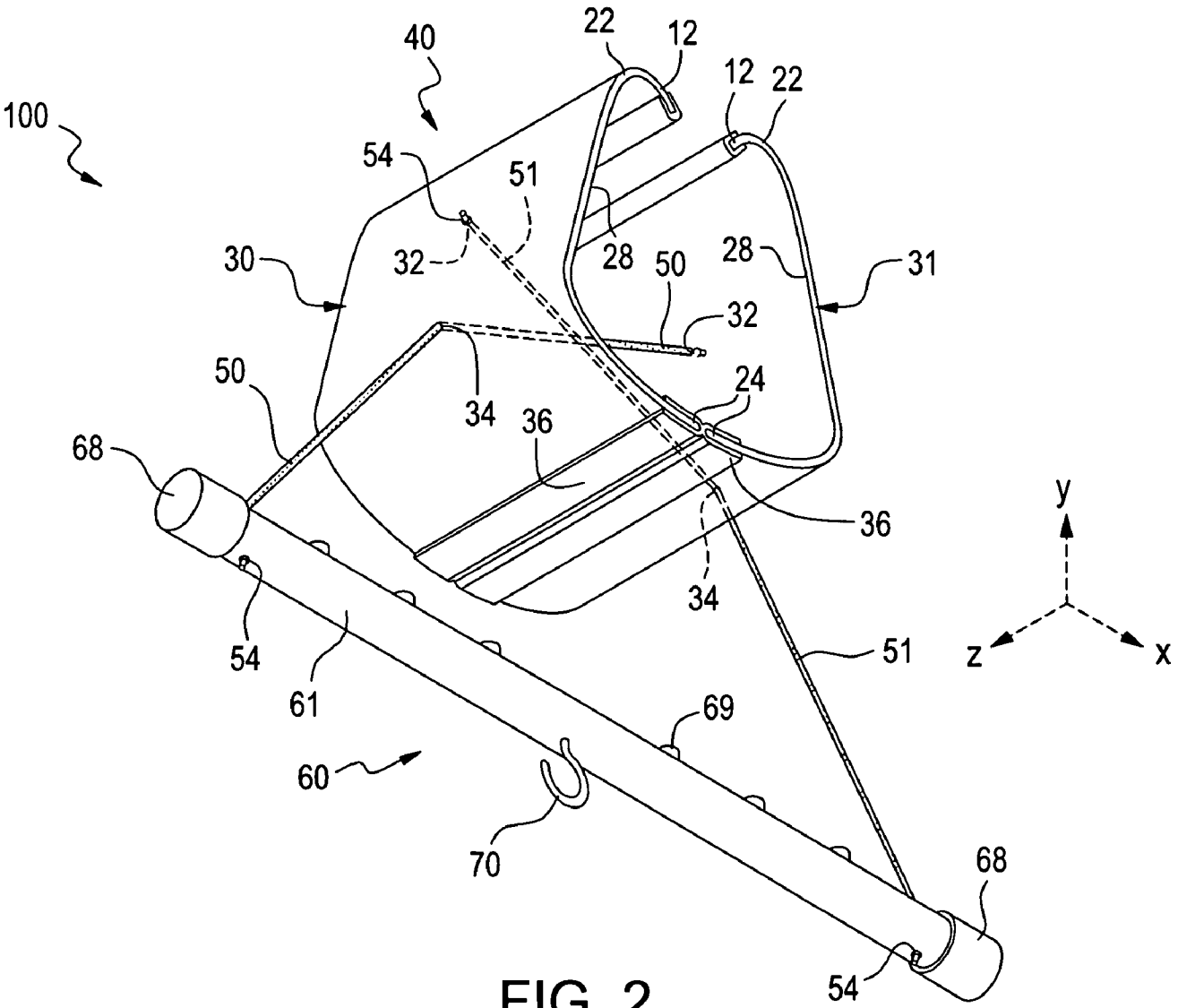
FIG. 2 illustrates the clothes support apparatus of FIG. 1.

In general, the present disclosure pertains to portable hanger support apparatuses for holding and supporting clothes hangers. FIG. 1 depicts an embodiment of a hanger support apparatus 100. The hanger support apparatus 100 is comprised of a clamp 40 with cords 50, 51 that couple the clamp 40 to a support bar 60. The clamp 40 has a first member 30 and a second member 31 wherein each member generally has a C-shape, but other shapes are possible in other embodiments. The members 30, 31 are symmetrically positioned with the concave surfaces of the C-shape facing each other. The members 30, 31 are pivotally coupled together on a lower end 24 as seen in FIG. 2, with a flexible connection clip 36. In other embodiments, pivotal couplings such as hinges, straps and the like that could provide the pivotal coupling. An upper end 22, as seen in FIG. 2, of each member 30, 31 forms a flange 12 (seen more clearly in FIG. 3) that extends toward the center of the clamp 40. In one embodiment of the disclosure, each flange 12 is approximately perpendicular to the inside surface of each member 30, 31. In other embodiments, other angles between the flange 12 and the inside surface of each member 30, 31 are possible. The distance between the flanges 12 changes as the members 30, 31 pivot about the flexible connection clip 36 coupling the lower ends 24 of the members 30, 31. When the apparatus 100 is installed, i.e., positioned to receive hangers with clothes, the flanges 12 make contact with the top edge 6 of opposing horizontal moldings 5. The cords 50, 51, as will be seen, provide a force for pulling the upper end 22 of each member 30, 31 together so that the flanges 12 contact one of the top edge 6 of moldings 5 and the wall above the moldings. In addition, the force from the cords creates a force of friction that helps to prevent the flanges 12 from separating from the wall or molding and/or from sliding off the top edge of the molding. The force pulling the members 30, 31 of the clamp 40 together is proportional to the weight of and on the support bar 60 as will be seen.

The hanger support apparatus 100 of FIG. 1 is shown in more detail in FIG. 2. In the embodiment of FIG. 2, the first member 30 and the second member 31 of the clamp 40 are coupled together at the lower edges 24 of the members with the connection clip 36. In one embodiment of the apparatus 100, as illustrated in FIG. 2, each of the members 30, 31 is composed of clear plastic. However, in other embodiments, the members 30, 31 are composed of other materials, such as metal, fiberglass, wood, or other types of materials. The members 30, 31, and are pivotally coupled together with the connection clip 36 at the lower end 24 of each of the members 30, 31 so that the concave surfaces 28 (the inside surfaces of the "C") face each other. The first member 30 and the second member 31 each have an upper hole 32 located between the center of the "C" and the upper end 22 of each of the members 30, 31. In addition, each of the members 30, 31 has a lower hole 34 located between the center of the "C" and the lower end 24 of each member.

A first cord 50 extends through the upper hole 32 of the first member 30 and goes across the inside of the clamp 40 to lower hole 34 of the second member 31. In one embodiment, a first end of the first cord 50 has a knot 54 that is too large to pass through the upper hole 32. Thus, the knot 54 presses against the exterior surface of the member 30 when a downward (the negative y direction) force, such as gravity, is applied to bar 60, thereby securing the cord 50 to the first member 30. In other embodiments, the upper end of the first cord 50 may be secured to the first member 30 at the location of the upper hole 32 using a variety of other connection techniques. The second end of the first cord 50 extends downward to and through the lower hole 34 of the second member 31. The first cord 50 further extends, approximately downward from the lower hole 34 of the second member 31, to a first end of support bar 60. The second end of the first cord 50 is then connected to the first end of the support bar 60. Similarly, a second cord 51 has its first end secured to the member 31 via a knot, similar to the knot 54 of the first cord 50. The second cord 51 passes through the upper hole 32 of the second member 31 and then extends through the lower hole 34 of the first member 30. The second end of the second cord 51 is connected to a second end of support bar 60.

The arrangement of the cords 50, 51 with respect to the members 30, 31 causes the flanges 12 of clamp 40 to rotate towards each other, when downward (the negative y direction) forces are applied to the second ends of the cords 50, 51. Such forces can result from gravity acting on the support bar 60 and/or clothes (not shown in FIG. 2) hanging from the support bar 60. Due to the downward forces applied to the second ends of the cords 50, 51, the members 50, 51 respectively pull on members 30, 31 with a forces referred to hereafter as the "clamp forces" which have a vertical and a horizontal component. The horizontal components of the clamp forces pull the arms towards each other. The vertical components of the clamp forces press the tips of the flanges 12 against the top 5 of the horizontal moldings 6 when the apparatus is positioned as shown in FIG. 1.

Figure 3:
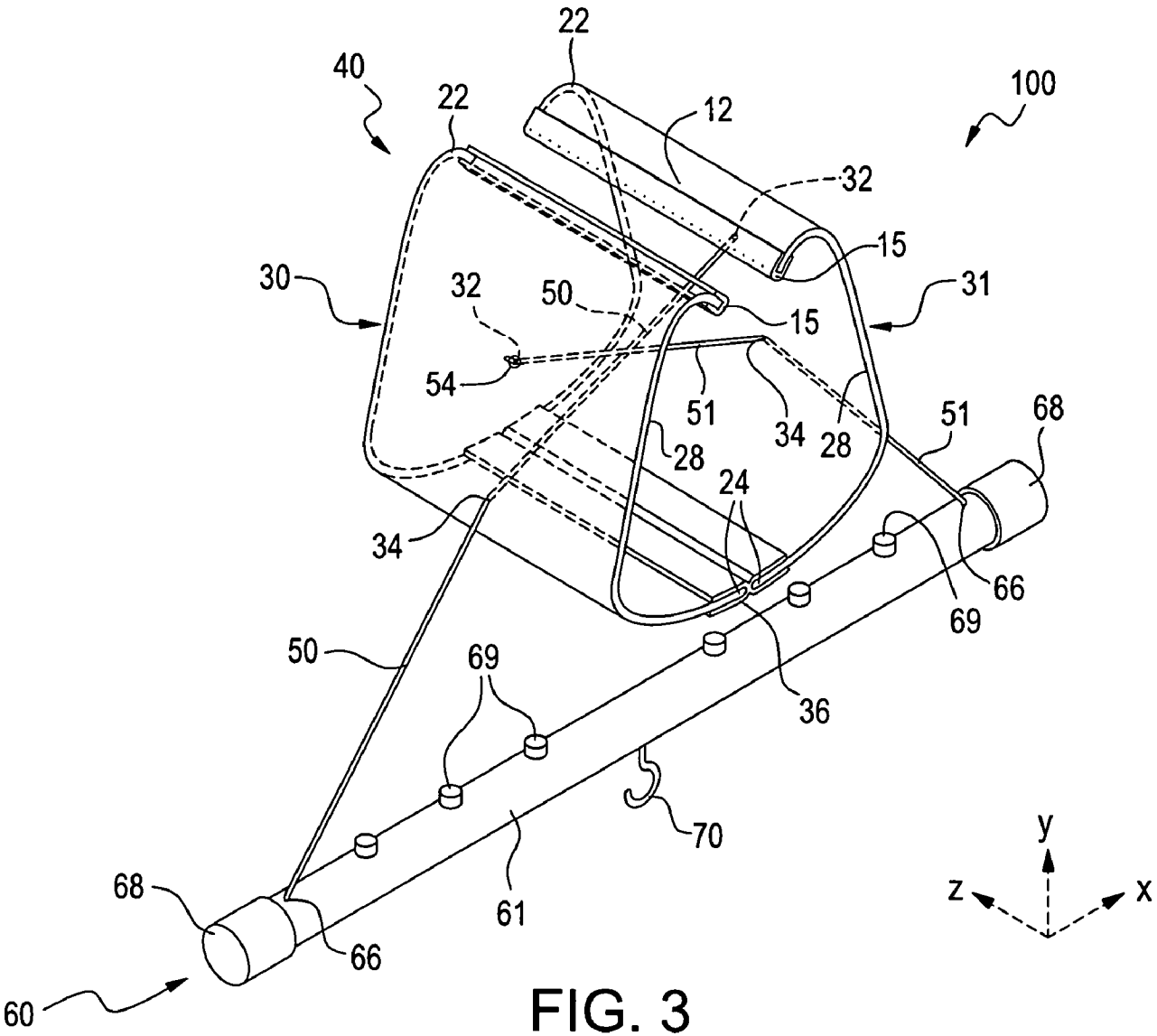
FIG. 3 illustrates the clothes support apparatus of FIG. 1.

FIG. 3 shows another perspective of the hanger support apparatus 100 of FIG. 1. FIG. 3 shows the inside surface 28 of the clamp 40. FIG. 3 further shows each cord 50, 51 going through a respective on of the second holes 34 of the members 30, 31 and passing through holes 66 in the support bar 60. A knot on the second end of the cords 50, 51 similar to the knot 54 that keeps the cords from passing back through holes 66 when an upward force is applied to the cords. The two members 30, 31 are shown with each flange 12 extending downward (the negative y direction) and inward (the x direction for member 30 and the negative x direction for member 31) from the upper ends 22 of the members. In one embodiment a cover 15 is placed over the tip of each flange 12. The cover 15 generally has a U shaped cross section and in one embodiment the cover is made of a soft flexible material, such as rubber or rubber-like material. The cover 15 is held in place by friction in one embodiment, but may be attached to the flanges 12 with adhesives, screws, or other types of devices and/or materials in other embodiments. The cover 15 helps to protect the wall and horizontal molding 5 from becoming blemished or marred by tips of the flange 12. The cover 15 may also have a relatively high coefficient of friction that helps keep each flange 12 in contact with the top 6 of the horizontal molding 5 and the wall above the molding.

In one embodiment of apparatus 100, the lower ends of the members 30, 31 are pivotally coupled together with the connection clip 36. The connection clip 36 has a first channel 38 (FIG. 4A) for receiving the lower end 24 of the first member 30 and a second channel 38 for receiving the lower end 24 of the second member 31. The back surfaces of channels 38 of the connection clip 36 can be abutted and secured together. In other embodiments, the connection clip 36 may be a single piece of material, such as an extrusion having two channels 38. In the extrusion embodiment, the connection clip 36 in cross section can be H-shaped, wherein the lower end 24 of each of the members 30, 31 fits into a respective one of the channels defined by the opening in the top and bottom of the H. The connection clip 36 is made of a flexible material so that the members 30, 31 may pivot inward or outward about the middle of the H-shape in response to an applied forces, such as the clamp forces. Each channel 38 of the connection clip 36 is dimensioned such that the lower end 24 of a respective member 30, 31 is held within the channel by friction from the walls of the channels and/or an adhesive. Hinges or similar elements that provide for pivoting may be used to provide a pivot coupling for the members 30, 31 as would be understood by those skilled in the art.

The support bar 60 is shown below the clamp 40 and coupled to an end of each cord 50, 51 through a respective hole 66 in the support bar. The support bar 60 in an embodiment as shown in FIG. 3 is comprised of a tube 61 having a cap 68, such as a rubber or plastic cap, covering each end of the tube. The caps 68 are secured to the ends of the tube by friction, adhesives, screws, other attachment devices and/or materials. The tube 61 has separation knobs 69 so that the weight of hangers with clothes is distributed somewhat uniformly. Further, if the support bar 60 gets inadvertently tipped, the separation knobs prevent the hangers from sliding to the lower end of the support bar 60. The separation knobs 69, in one embodiment, are made of rubber or similar material and snap into holes in the tube 61. In other embodiments, screws, bolts, pegs, dowels, pins, rods or other element may serve as separation knobs 69. In one embodiment, a J-bolt 70 goes through the center of the tube 61 with the hook of the J-bolt 70 extending downward. The J-bolt may be used to support a hanger when the hanger support apparatus 100 is attached to a doorframe. The J-bolt may also be used to suspend the hanger support apparatus from a peg or nail when the apparatus 100 is removed from the doorframe and placed in storage.

Figure 4B:
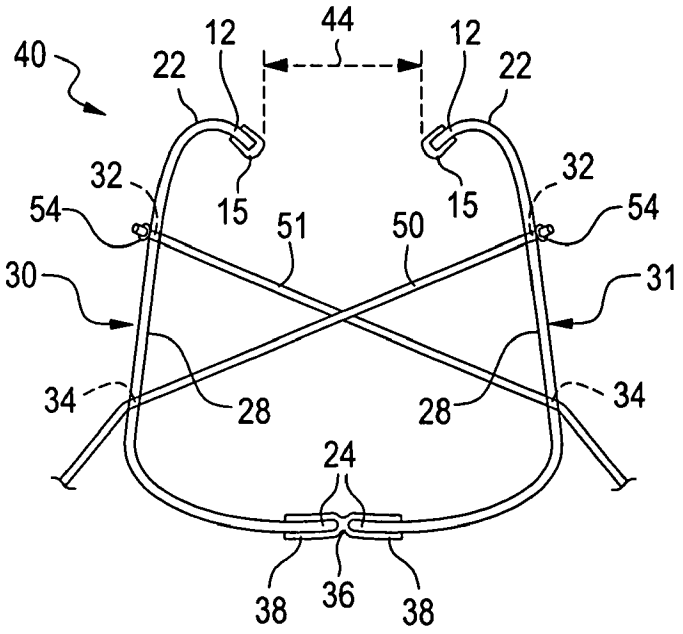
FIG. 4B illustrates a side view of the support apparatus of FIG. 1 depicting the elements in a different position.
Figure 4A:
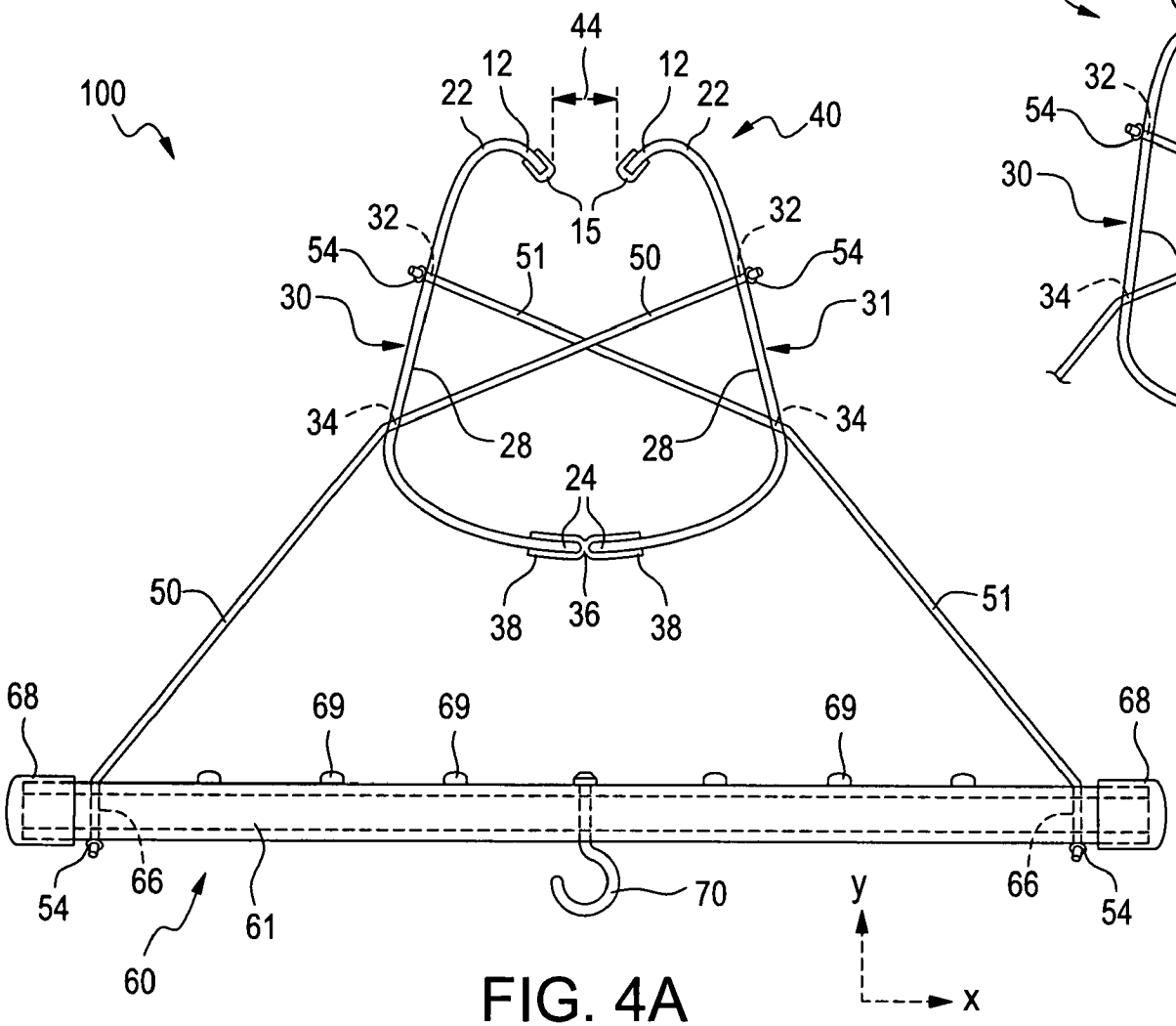
FIG. 4A illustrates a side view of the support apparatus of FIG. 1.

FIG. 4A depicts a side view of the hanger support apparatus 100 of FIG. 1. FIG. 4A illustrates exemplary positions the flanges 12 when the apparatus 100 is in a closed position so that the apparatus may be attached to the top 6 of horizontal moldings 5. In the closed position, an opening 44, defined by the distance between the tip of each of the flanges, is approximately equal to the thickness of the wall between the inside surfaces of the horizontal moldings 6. FIG. 4A also shows the cords 50, 51 as the cords extended across the space between the members 30, 31. In addition, the side view shows exemplary covers 15 that fit over the tips of the flanges 12. The connection clip 36, as shown in the side view of FIG. 4A, has channels 38 that respectively receive the lower ends 24 of the members 30, 31. FIG. 4B shows the members 30, 31 when the clamp 40 is an opened position. In the opened position, the opening 44 is at least as great as the distance between the outside surfaces of the horizontal moldings 6 in order for the clamp 40 to be placed in a position for closing. The clamp 40, transitions from a closed position to an opened position when sufficient outward forces are applied to the members 30, 31. When such outward forces are applied, each member 30, 31 pivots outward, because of the flexibility of the connection clip 38. Similarly, the clamp 40 transitions from an opened position to a closed position when inward forces, such as the clamp forces, pull the members 30, 31 towards each other.

Figure 5:
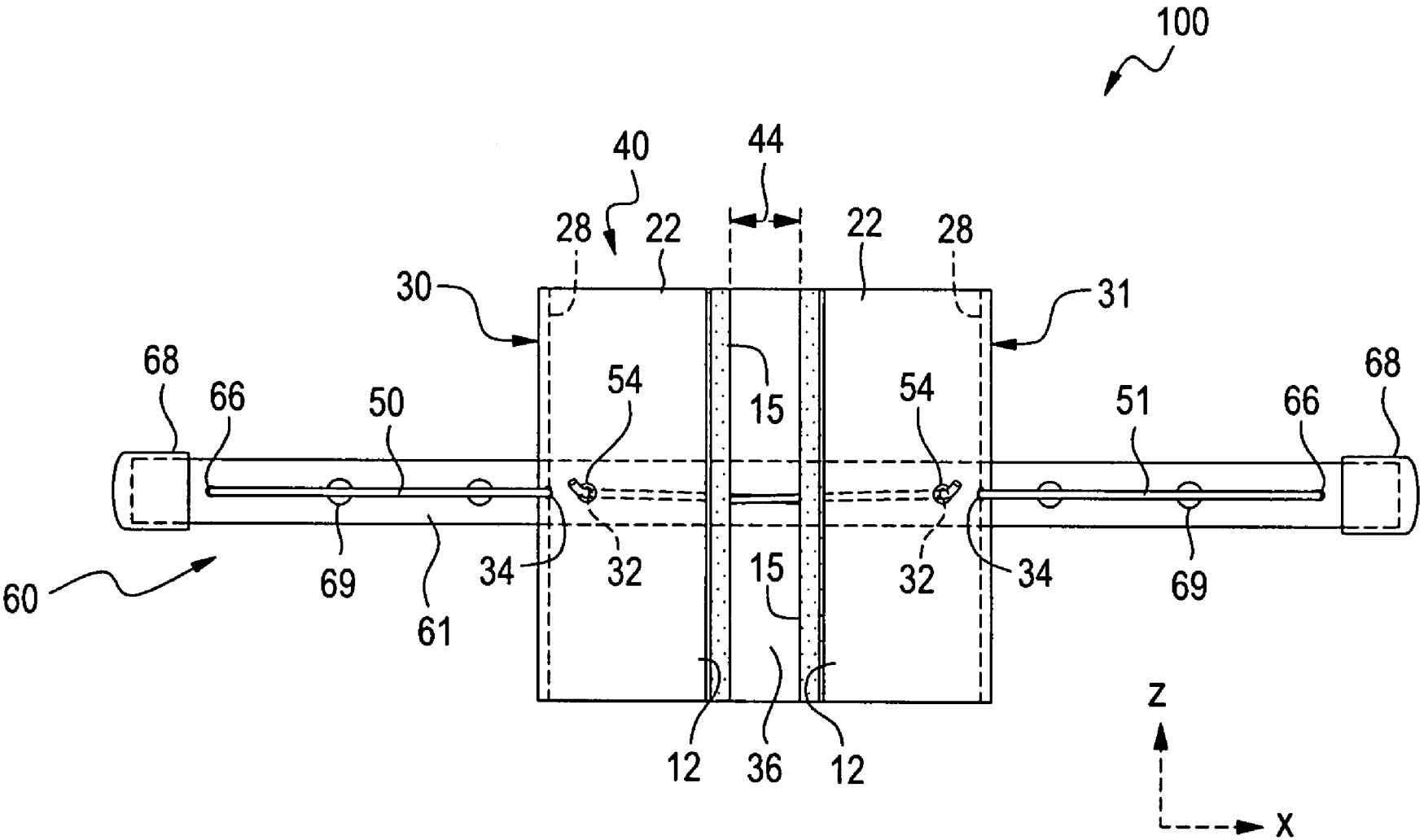
FIG. 5 illustrates a top view of the clothes support apparatus of FIG. 1.

A top view of the hanger support apparatus, FIG. 5, shows an opening between flanges 12 on the top edges of the members 30, 31. When the flanges 12 and members 30, 31 of the clamp 40 are moved outward (the x-direction and the negative x-direction respectively), the opening 44 between the flanges 12 is increased. As the members 30, 31 are separated, the cords 50, 51 are pulled through the lower holes 34 thereby decreasing the length of cord between the lower holes 34 and the ends of the support bar 60. When opening 44 is at least as wide as the distance between the outside surfaces of the horizontal door moldings 6, the clamp 40 is in the opened position as previously described.

Figure 6A:
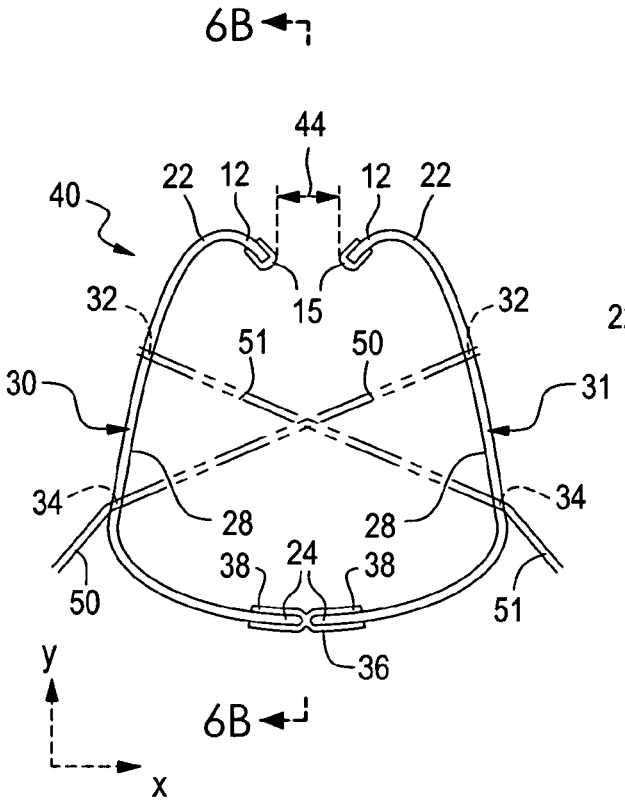
FIG. 6A is side view of an embodiment of a clamp for the support apparatus of FIG. 1.
Figure 6B:
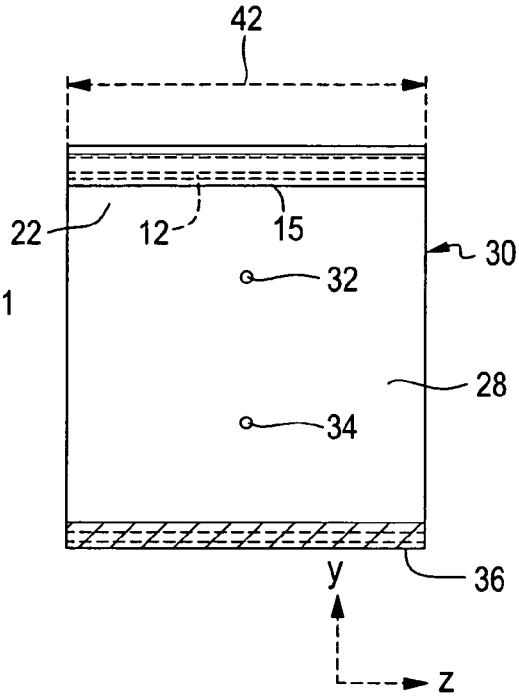
FIG. 6B is section side view of the clamp of FIG. 6A.

FIG. 6A illustrates an end view of the clamp 40 for the hanger support apparatus 100 of FIG. 1. The upper holes 32 are shown to be somewhat above (measured in the y direction) the center of each member 30, 31. The lower hole 34 is shown to be about half way between the center of each member 30, 31 and the lower end 24 of each member. The concave surfaces 28 of the C-shaped members are shown facing each other. The section view, FIG. 6B, of the clamp 40 shows the first member 30 having a width 42, and the holes 32, 34 located in approximately the middle of the member when measuring in the z direction. In general, such as in the embodiment of FIG. 6A, the first member 30 and the second member 31 are identical, so that the section view of the second member 31 would look the essentially the same as the section view for the first member 30. The holes as seen in FIG. 6A are round, but other hole shapes may be used in other embodiments. Further, in other embodiments the holes are located at other locations. In addition, the shape of each hole is dependent on the shape and structure of the cords 50, 51. In some embodiments the cords 50, 51 are round and are composed of materials typically used to make ropes and strings. In other embodiments the cords may be straps or rods with little or no flexibility.

Figure 7:
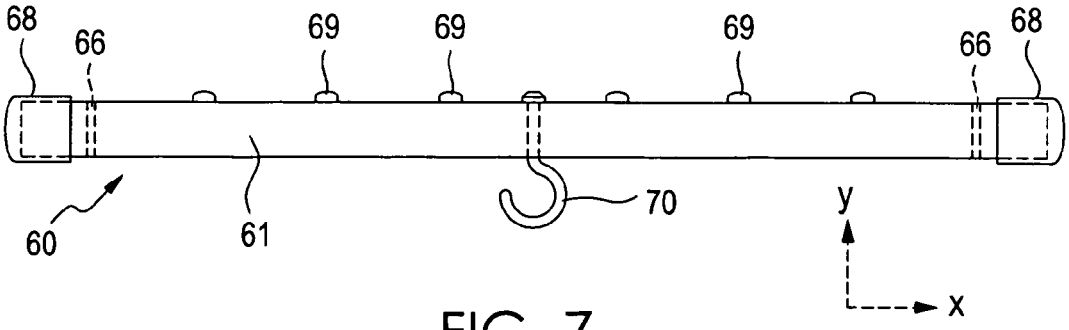
FIG. 7 illustrates a support bar depicted in FIG. 1.

FIG. 7 shows the support bar 60 having caps 68 on each end of tube 61. The J-bolt 70 is shown extending through the tube 61 with the hook end of the J-bolt below (the negative y direction) the tube 61. Coupling holes 66 in the tube 61 are used for receiving the second ends of the cords 50, 51 and a knot 54 on the end of the cords may be used to secure the cords to the tube 61. However, in other embodiment the second ends of the cords 50, 51 may be attached using other attachment techniques.

While embodiments of the disclosure has been described in detail, it is to be expressly understood that it will be apparent to persons skilled in the relevant art that the embodiments may be modified without departing from the spirit of the disclosure. Therefore, the above mentioned description is to be considered exemplary, rather than limiting, and the true scope of the invention is that defined in the following claims.

What is claimed:

1. A portable hanger support apparatus for mounting to moldings of a frame, the apparatus comprising:

a clamp having a first member and a second member, the first member having a first end forming a first flange and the second member having a second end forming a second flange, the first member further having a first edge opposing the first end forming the flange and the second member further having a second edge opposing the second end forming the flange;

a unitary connector comprising a first channel flexibly connected to a second channel, the channels receiving and retaining the first edge and the second edge of the first member and the second member, respectively;

a first cord coupled to the first member, the first cord extending through a hole in the second member;

a second cord coupled to the second member, the second cord extending through a hole in the first member; and a support bar coupled to the first and second cords, such that when a downward force is applied to the support bar, the first cord and the second cord cause the first member and the second member to move in a direction toward one another when the unitary connector gives between the first channel and the flexibly connected second channel.

2. The apparatus of claim 1, wherein each of the members has a C-shape.

3. The apparatus of claim 2, wherein a covering is placed over the flange of each member.

4. The apparatus of claim 1, wherein the support bar has separation knobs.

5. The apparatus of claim 1, wherein an end of the first cord is coupled to said first member via a knot in said first cord that prevents the first cord from passing through a hole in the first member.

6. The apparatus of claim 1, wherein the first member is pivotally connected to the second member via said unitary connector.

7. A portable hanger support apparatus for mounting to moldings of a frame, the apparatus comprising:

a clamp having a first member and a second member, the first member having a first edge and the second member having a second edge, the first edge securely fits within a first u-shaped channel and the second edge securely fits within a second u-shaped channel, and the u-shaped channels are flexibly connected thereby forming a flexible connector clip pivotally connecting the first member to the second member, the first member having a third edge opposite to the first edge, the third edge forming a flange and the second member having a fourth edge opposite to the second edge, the fourth edge forming a flange;

a first cord coupled to the first member, the first cord extending through a hole in the second member;

a second cord coupled to the second member, the second cord extending through a hole in the first member; and a support bar coupled to the first and second cords.

8. The apparatus of claim 7, wherein the flange of the first member and the flange of the second member are adapted for contacting at least one moldings of a frame.

9. A hanger support apparatus for supporting hangers comprising:

a clamp having a first member pivotally coupled to a second member, wherein a first end of the first member is adapted for coupling to a molding and a first end of the second member is adapted for coupling to the molding, wherein a second end of the first member couples to a first u-shaped channel of a flexible connector and a second end of the second member couples to a second u-shaped channel of the flexible connector;

a first cord extending from the first member through a hole in the second member;

a second cord extending from the second member through a hole in the first member; and a support bar coupled to the first and second cords, wherein when an object is hung on the support bar a force is exerted on the first and second members through said first and second cords such that the flexible connector operates to allow the first and second members to move in a direction toward one another.

10. The apparatus of claim 9, wherein the support bar has hanger separation knobs.

11. The apparatus of claim 9, wherein the cords transfer force from the support bar to the members for pulling the members together.

12. The apparatus of claim 9, wherein each of the members is C-shaped having a concave surface, and the concave surfaces face each other.

* * * * *